US009386682B2

(12) United States Patent
Tantawi et al.

(10) Patent No.: US 9,386,682 B2
(45) Date of Patent: Jul. 5, 2016

(54) DISTRIBUTED COUPLING AND MULTI-FREQUENCY MICROWAVE ACCELERATORS

(71) Applicant: The Board of Trustees of the Leland Stanford Junior University, Palo Alto, CA (US)

(72) Inventors: Sami G. Tantawi, Stanford, CA (US); Zenghai Li, Sunnyvale, CA (US); Philipp Borchard, San Francisco, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 14/795,490

(22) Filed: Jul. 9, 2015

(65) Prior Publication Data

US 2016/0014876 A1 Jan. 14, 2016

Related U.S. Application Data

(60) Provisional application No. 62/022,469, filed on Jul. 9, 2014.

(51) Int. Cl.

| | |
|---|---|
| ***H05H 9/02*** | (2006.01) |
| ***H01P 3/12*** | (2006.01) |
| ***H05H 9/00*** | (2006.01) |
| ***H01P 11/00*** | (2006.01) |

(Continued)

(52) U.S. Cl.
CPC ..... *H05H 7/02* (2013.01); *H01P 1/207* (2013.01); *H05H 9/00* (2013.01); *H05H 2007/027* (2013.01)

(58) Field of Classification Search
None
See application file for complete search history.

(56) References Cited

U.S. PATENT DOCUMENTS 4,006,422 A * 2/1977 Schriber ..... H05H 9/04 315/5.41
4,118,653 A * 10/1978 Vaguine ..... H05H 9/00 315/3.6

(Continued)

OTHER PUBLICATIONS

Neilson J et al. SLAC Pub 15008 Design of RF Feed System for Standing Wave Accelerator Structures, 14th Advanced Accelerator Concepts Workshop AIP Conference Proceedings vol. 1299 pp. 463-466 Nov. 2010.*

(Continued)

*Primary Examiner* — Crystal L Hammond
(74) *Attorney, Agent, or Firm* — Lumen Patent Firm

(57) ABSTRACT

A microwave circuit for a linear accelerator has multiple metallic cell sections, a pair of distribution waveguide manifolds, and a sequence of feed arms connecting the manifolds to the cell sections. The distribution waveguide manifolds are connected to the cell sections so that alternating pairs of cell sections are connected to opposite distribution waveguide manifolds. The distribution waveguide manifolds have concave modifications of their walls opposite the feed arms, and the feed arms have portions of two distinct widths. In some embodiments, the distribution waveguide manifolds are connected to the cell sections by two different types of junctions adapted to allow two frequency operation. The microwave circuit may be manufactured by making two quasi-identical parts, and joining the two parts to form the microwave circuit, thereby allowing for many manufacturing techniques including electron beam welding, and thereby allowing the use of un-annealled copper alloys, and hence greater tolerance to high gradient operation.

8 Claims, 9 Drawing Sheets

(51) Int. Cl.
*H05H 7/02* (2006.01)
*H01P 1/207* (2006.01)

(56) References Cited

U.S. PATENT DOCUMENTS 5,380,386 A * 1/1995 Oldham ..... H01P 11/00 156/150
6,316,876 B1 * 11/2001 Tanabe ..... H05H 7/18 315/5.39
6,407,505 B1 * 6/2002 Bertsche ..... H05H 9/04 315/5.41
6,646,383 B2 * 11/2003 Bertsche ..... H05H 7/22 315/111.61
7,339,320 B1 * 3/2008 Meddaugh ..... H05H 9/048 315/5.41
8,232,749 B1 * 7/2012 Barov ..... H05H 7/18 315/5.41
8,664,617 B2 * 3/2014 Fortt ..... G01N 21/05 250/373
2005/0212465 A1 * 9/2005 Zavadtsev ..... H05H 7/00 315/500
2009/0302785 A1 * 12/2009 Miller ..... H05H 9/04 315/505
2015/0359080 A1 * 12/2015 Dolgashev ..... H05H 7/02 315/505

OTHER PUBLICATIONS

Neilson, J. et al., SLAC-PUB-15008, "Design of RF Feed System for Standing-Wave Accelerator Structures," Advanced Accelerator Concepts: 14th Advanced Accelerator Concepts Workshop. AIP Conference Proceedings, vol. 1299, pp. 463-466 (Nov. 2010).
Tantawi, S., SLAC-PUB-12104, "On the RF Distribution System for a Set of Standing-Wave Accelerator Structures", Phys. Rev. ST Accel. Beams, vol. 9, Issue 11, 2006.
Neilson, J. et al., SLAC-PUB-15242, "Design of RF Feed System for Standing-Wave Accelerator Structures," Proceedings, 2nd International Conference, IPAC 2011, San Sebastian, Spain, Sep. 4-9.

* cited by examiner

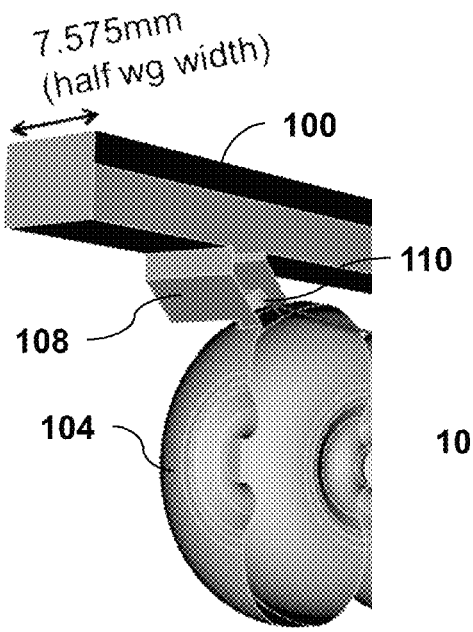
Fig. 1A
Fig. 1B
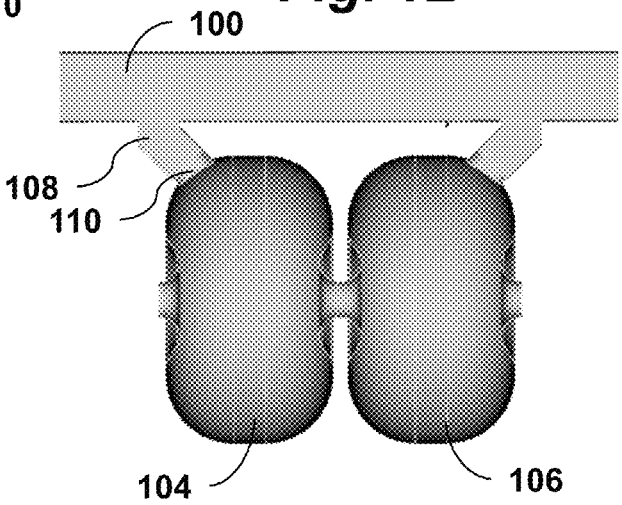
Fig. 1C
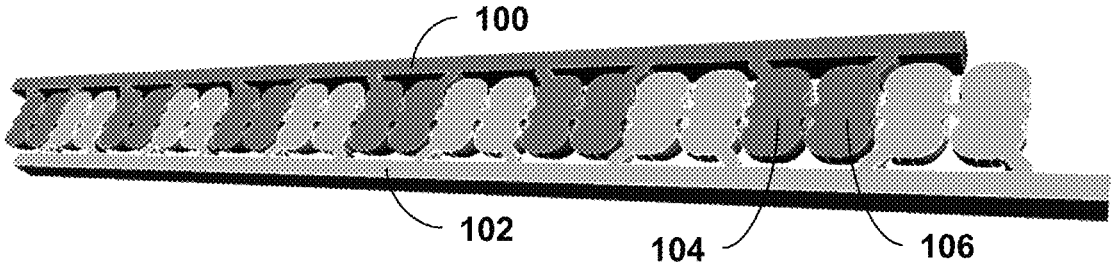

f=11.424 GHz
Rs=181 MΩ/m f=18.309 GHz
Rs=63 MΩ/m

DISTRIBUTED COUPLING AND MULTI-FREQUENCY MICROWAVE ACCELERATORS

CROSS-REFERENCE TO RELATED APPLICATIONS

This application claims priority from U.S. Provisional Patent Application 62/022,469 filed Jul. 9, 2014, which is incorporated herein by reference.

STATEMENT OF GOVERNMENT SPONSORED SUPPORT

This invention was made with Government support under grant (or contract) no. DE-AC02-76SF00515 awarded by the Department of Energy. The Government has certain rights in the invention.

FIELD OF THE INVENTION

The present invention relates generally to linear accelerators. More specifically, it relates to improved microwave linear accelerators.

BACKGROUND OF THE INVENTION

A linear particle accelerator (linac) accelerates charged particles using a series of oscillating electric potentials generated by RF cells joined together to form a linear beamline. At one end of the linac, the particles from a particle source are injected into the beamline using a high voltage. The typical design process for a linear accelerator requires careful consideration of the coupling parameters between adjacent cells. These structures are fed from one single point or input guide and the power flows from that point to all cells through coupling holes which typically also serve as the beam tunnel for the particles being accelerated. Coupling between cells limits the ability of designers to optimize the cell shape for efficiency (high shunt impedance) and power and gradient handling capability.

Commonly owned U.S. Pat. Appl. Pub. 20140191654 entitled "Distributed Coupling High Efficiency Linear Accelerator", which is incorporated herein by reference, describes a practical implementation of a microwave circuit that is capable of separately feeding multiple cavities while minimizing the coupling between cavities. This design, however, has a somewhat complicated structure in the case of coupling to each cavity. In the case of coupling to every few cavities, it has a simple structure but at the expense of a reduced efficiency. Accordingly, there remains a need for further improvement in efficient linac design.

SUMMARY OF THE INVENTION

Improving on the earlier work described in U.S. Pat. Appl. Pub. 20140191654 as discussed above, the present invention simultaneously provides a simple design that couples to each cavity while also attaining a maximum efficiency. The simplicity of the design is thus less expensive to manufacture and also provides superior performance. This improvement can benefit various applications of linacs, including scientific research, national security, and medical, and industrial applications.

In one aspect, this invention presents a new topology for microwave accelerators that optimizes their efficiency. It allows linear accelerators to operate with much less power for a given acceleration gradient than existing accelerators. This design allows the structure to be highly efficient and also allows the structure to be built economically because of the smaller number of parts. It allows the structure to operate at even higher efficiency if one uses two frequencies and two modes. It allows for extremely high gradient operation, especially in the two-modes, two-frequency topology because the fields from the two modes do not add simultaneously on the surface. It allows high repetition rate because the losses on the wall is minimized. If this design is implemented in superconducting linac it allows the dynamic losses, which impact the needed refrigeration power, to be reduced by more than a factor of 2. For superconducting machines the structure could be optimized to maximize the gradient by minimizing the magnetic field, hence the maximum gradient attained by superconducting accelerators could be extended substantially. With this design, a 65 MV/m accelerator at L-band may be realized.

Innovative features include one or more of the following: The design provides coupling to each cell in the structure. It has a simple and very low loss distribution network. It provides the highest possible shunt impedance for a given set of cells. Because of the topology of the distribution system, it allows the manufacturing of the accelerator structure from only two blocks. This is in contrast to typical structures that are manufactured from 10's of cells brazed together. It leaves room for two distribution systems, and hence one can feed the structure at two different frequencies allowing for even better shunt impedance and ever lower power for a given gradient.

In one aspect, the invention provides a microwave circuit for a linear accelerator. The circuit includes multiple metallic cell sections, a pair of distribution waveguide manifolds, and a sequence of feed arms connecting the manifolds to the cell sections. The distribution waveguide manifolds are connected to the cell sections so that alternating pairs of cell sections are connected to opposite distribution waveguide manifolds. The distribution waveguide manifolds have concave modifications of their walls opposite the feed arms, and the feed arms have portions of two distinct widths. The coupling geometry to each cell section is preferably implemented with a three port network adapted such that a dependence of the accelerator cavity design on a distribution manifold circuit parameter is minimized. The three port network is an E-plane junction, and the waveguide manifolds and three-port network are formed from two parts joined along the E-plane. In some embodiments, the distribution waveguide manifolds are connected to the cell sections by two different types of junctions adapted to allow two frequency operation. Each distribution waveguide manifold may be composed of identical units, whereby power may be distributed evenly between accelerator structures. The distribution waveguide preferably matches a set of standing wave accelerator structures and allows for reflected power be output to external loads.

In another aspect, the invention provides a method of manufacturing a microwave circuit for a linear accelerator by making two quasi-identical parts, and joining the two parts to form the microwave circuit, where the microwave circuit comprises multiple metallic cell sections, a pair of distribution waveguide manifolds, and a sequence of feed arms connecting the manifolds to the cell sections, where the distribution waveguide manifolds are connected to the cell sections so that alternating pairs of cell sections are connected to opposite distribution waveguide manifolds, thereby allowing for many manufacturing techniques including electron beam welding, and thereby allowing the use of un-annealled copper alloys, and hence greater tolerance to high gradient operation.

The distribution waveguide manifolds preferably have concave modifications of their walls opposite the feed arms, and wherein the feed arms have portions of two distinct widths.

BRIEF DESCRIPTION OF THE DRAWINGS

FIGS. 1A-C show cut-away and cross-sectional views of two manifolds for feeding every cell in a pi mode accelerator structure, according to an embodiment of the invention.

DETAILED DESCRIPTION

Figure 2:
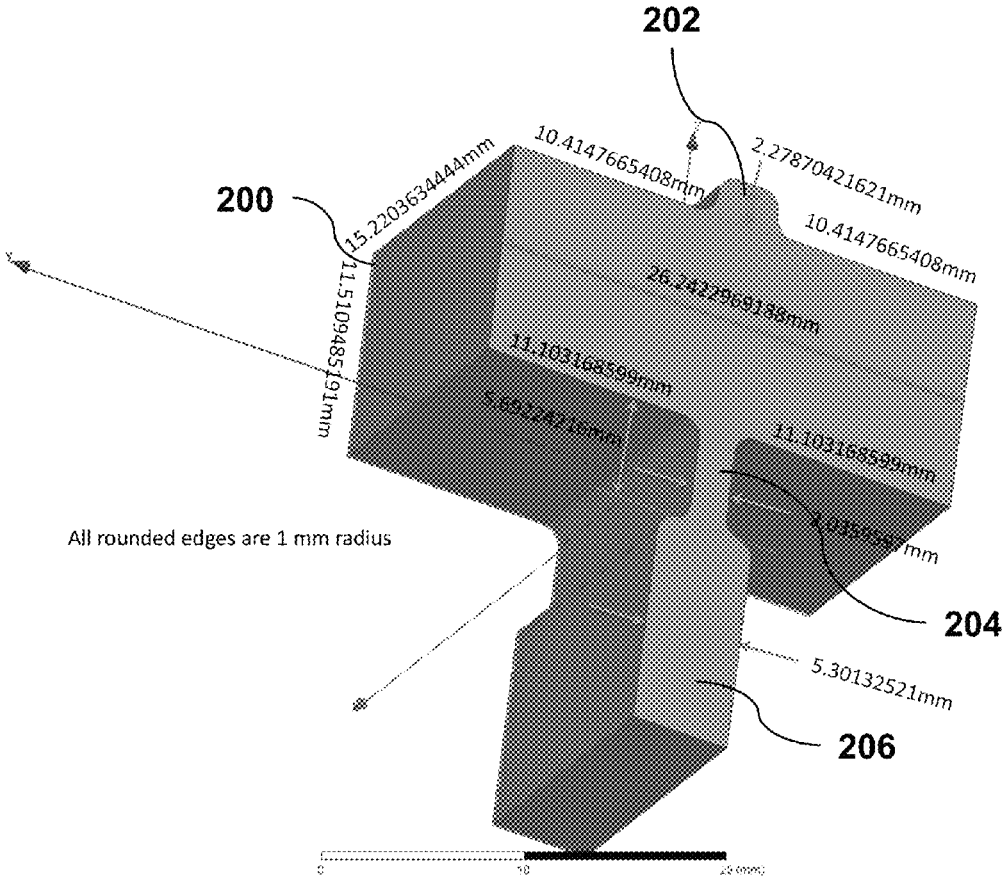
FIG. 2 is a perspective view of a three port network used for each tap-off of an accelerator structure, according to an embodiment of the invention.

Preferred embodiments of the invention will now be described in relation to the figures. For specific examples, for purposes of illustration only, the dimensions are based on an operating frequency of 11.424 GHz. Based on the teachings provided herein, the design methodology can be extended to any other band, as will be shown by specific calculations for other bands later in the description.

The topology of one embodiment of an accelerator structure according to the invention is shown in FIGS. 1A-C. Two manifolds 100, 102 are feeding the structure cavities in pairs, where the two cavities in each pair are adjacent to each other and where the pairs alternately couple to one or the other of the two manifolds. Every cavity is coupled to one of the manifolds. In this embodiment, the distance between feeding points at the feeding waveguide manifold is larger than the periodic distance or the spacing between the centers of the adjacent cavities. Hence, if one operates at the pi mode, the required distance between the feeding points should be ~½ of a guide wavelength, which is always greater than the distance between the centers of the cavity, which is a ½ a free space wavelength. This way, with only two manifolds, one can feed every cavity in the system. Note that the π mode is not a necessity but it turns out that it is very close to being optimal.

Each accelerator cavity is coupled to a manifold by a junction. For example, cavity 104 is coupled to manifold 100 by junction 108. The cavity 104 has a coupling iris 110 whose corners are preferably rounded.

Figure 3A:
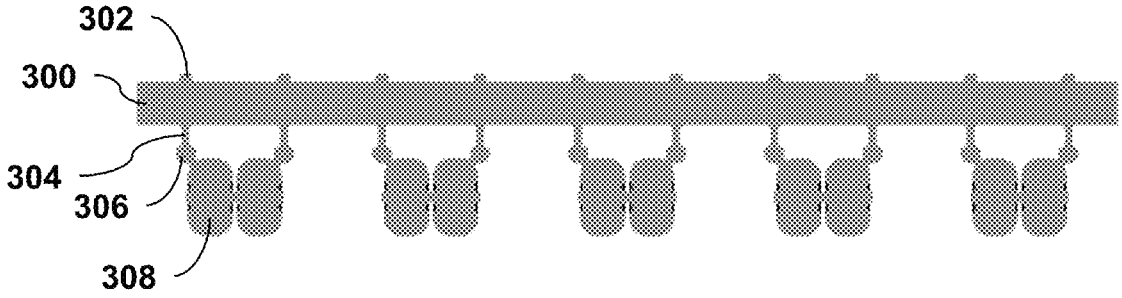
FIGS. 3A-B show schematic and cut-away views of coupling details for an accelerator structure, according to an embodiment of the invention.
Figure 3B:
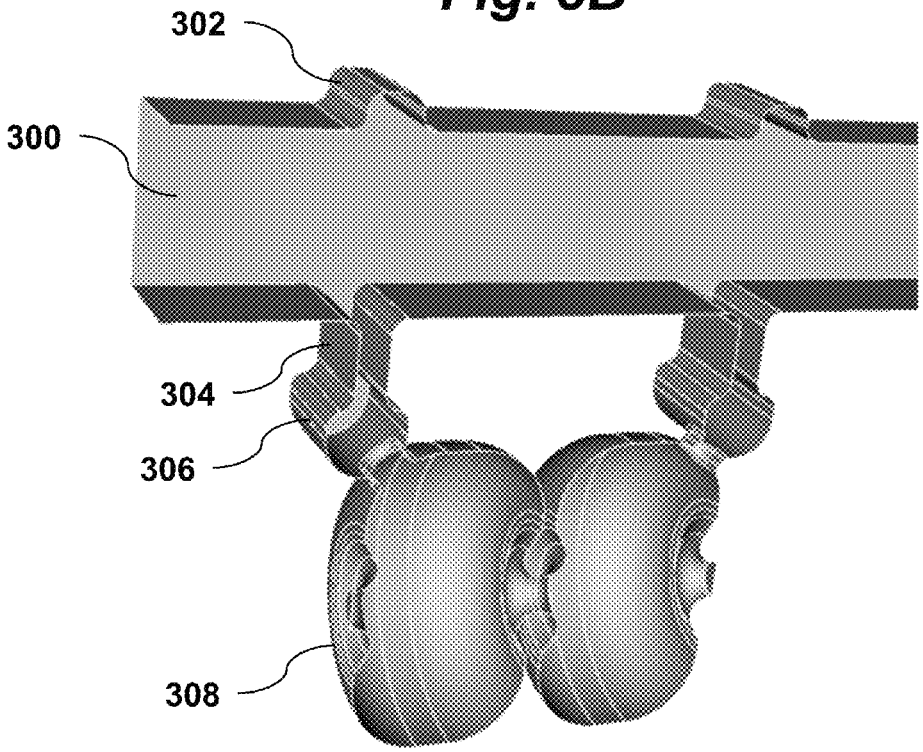
Figure 4:
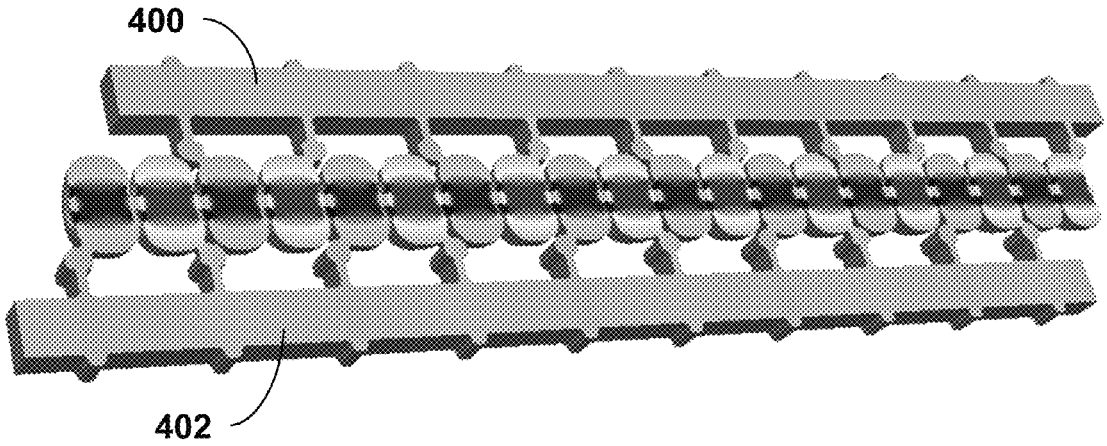
FIG. 4 is a cut-away view of an accelerator structure, where E-field intensity is indicated by shading, according to an embodiment of the invention.

Another aspect of this embodiment is the design of the manifold junction. The optimal design of the manifold junction should achieve a minimal standing wave within the manifold waveguide. To this end, each three port network representing the manifold with a feed point, as shown in FIG. 2, has the following scattering matrix:

$$S=\begin{pmatrix} \frac{1}{-1-2n} & -1+\frac{1}{1+2n} & -\frac{2e^{i\sigma}\sqrt{n}}{1+2n} \\ -1+\frac{1}{1+2n} & \frac{1}{-1-2n} & \frac{2e^{i\sigma}\sqrt{n}}{1+2n} \\ -\frac{2e^{i\sigma}\sqrt{n}}{1+2n} & \frac{2e^{i\sigma}\sqrt{n}}{1+2n} & e^{2i\sigma}\left(-1+\frac{2}{1+2n}\right) \end{pmatrix},$$

where n is the number of cavities feed by a single manifold. This would guarantee attaining a minimal VSWR along the manifold. To achieve this matrix, one modifies the shape of the waveguide around the manifold 200, as shown in FIG. 2. A feature 202 is a protrusion on the wall of the waveguide opposite to the wall with the feed 204 of the junction. Another feature 204 is widening of the feed from a narrow portion 204 to a wider portion 206. With these features shown in FIG. 2, the manifold exerts minimal influence on the cavity, for which the coupling could be adjusted separately and hence the design is insensitive to the distance between the manifold and the cavities. This is a very important feature of this design which allows the system to be tunable and could be manufactured with lower tolerances. The accelerator structure with these features is shown in FIGS. 3A-B, which show a waveguide manifold 300 with protrusion 302 opposite feed with narrow portion 304 and wide portion 306. The feed couples manifold 300 to cavity 308. Other cavities, feeds, and protrusions are similarly designed, forming a periodic accelerator structure. The simulation of the fields in the structure is shown in FIG. 4, which shows two parallel manifold waveguides 400 and 402 coupled to a series of 20 cavities by coupling junctions. The shading represents the intensity of the E field in the structure, where the field intensity in the manifolds is reduced compared to that near the center of the cavities where the beamline is positioned.

Figure 5A:
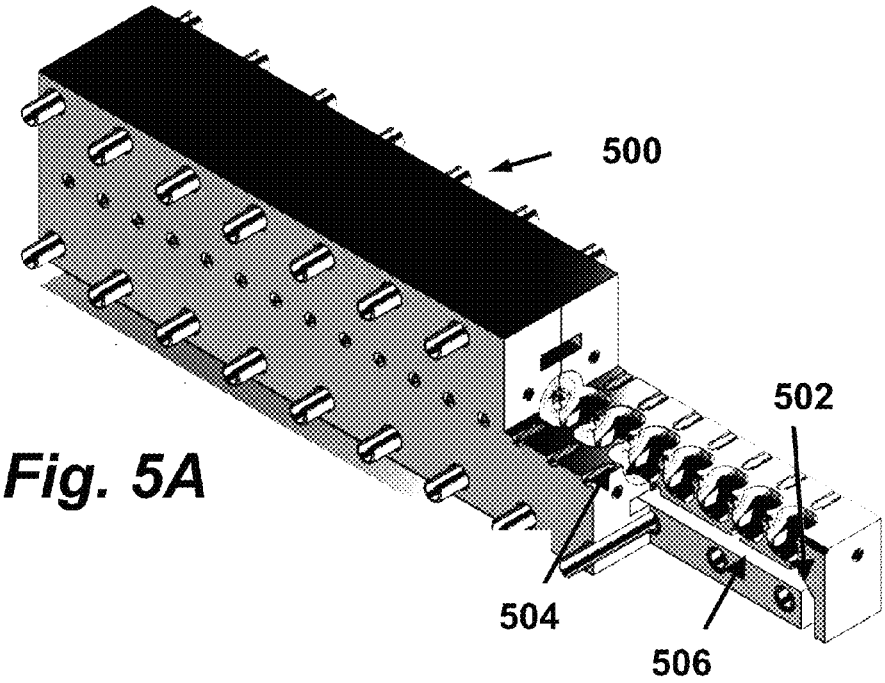
FIGS. 5A-B are perspective cut-away views of an accelerator section, where the split plane is orthogonal to feed waveguide, according to an embodiment of the invention.
Figure 5B:
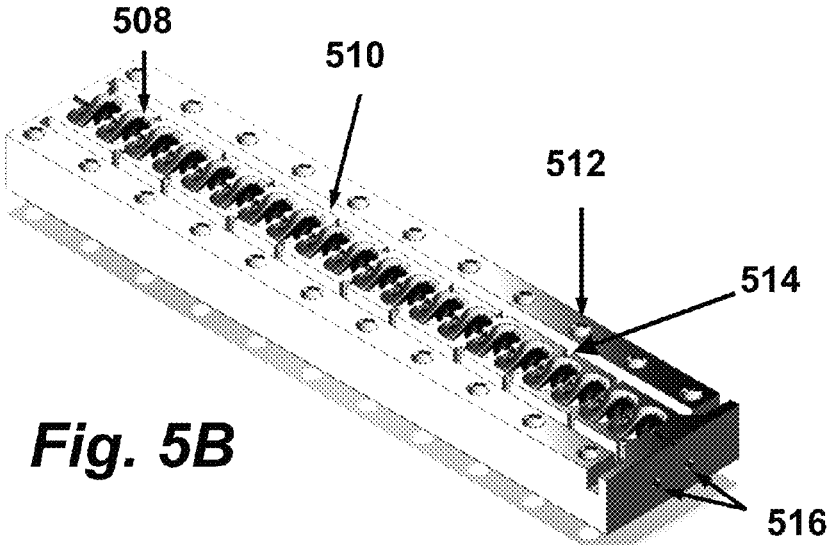

Each segment of the accelerator structure can be manufactured from two blocks as shown in FIGS. 5A-B for an accelerator divided into four segments with 20 cells each. Both the manifolds and the cavities have no currents crossing the plane which splits the manifold in half along the long dimension of the manifold cross section. This allows the structure to be built out of just two blocks. This reduces the complexity of manufacturing the structure and provides logical places for both the cooling manifolds and the tuning holes. FIG. 5A is a cut-away view of braze assembly including inconel spring pin (nickel 'superalloy') 500, miter bend 502, tuning pin (two per cell) 504, and feed waveguide 506. FIG. 5B shows a circuit 'half' including accelerator cell 508, feed waveguide 510, precision alignment holes 512, coupling hole 514, and axial coolant holes 516. The circuit halves are aligned with an elastic averaging technique. Improved accuracy is derived from the averaging of error over a large number of contacting surfaces.

Figure 6:
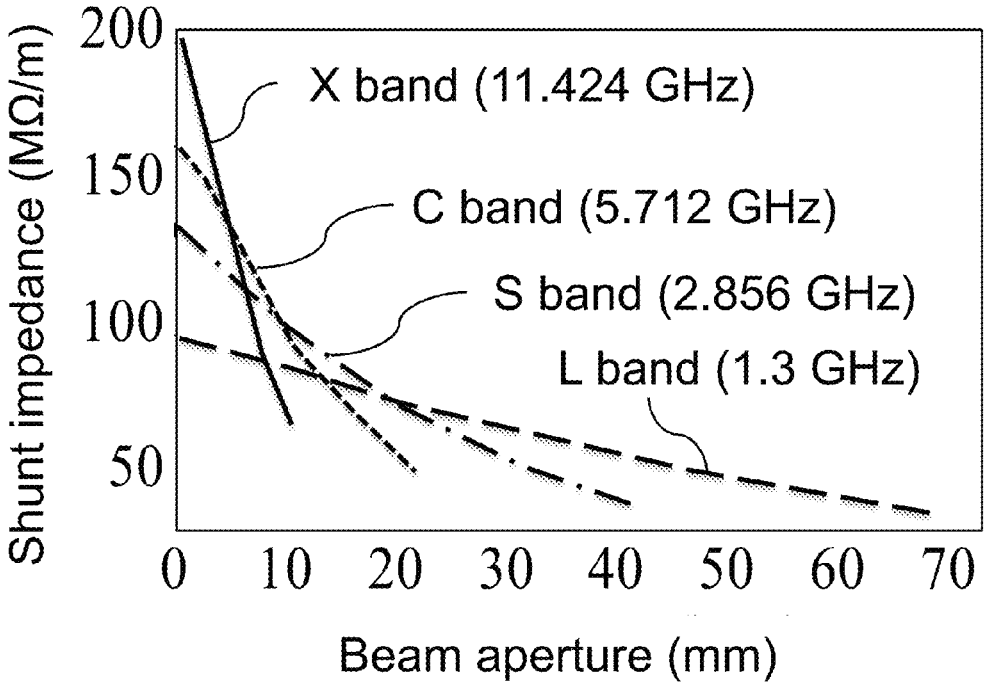
FIG. 6 is a graph of shunt impedance vs. beam aperture for several bands, illustrating frequency choice for highly optimized standing-wave structure with distributed feeding, according to an embodiment of the invention.

Although the designs of the structures shown in the above figures are done for a structure operating at 11.424 GHz, we now show the advantages of using this type of structures at other bands. The shunt impedance for an optimized design at different aperture opening and different frequency bands is shown in FIG. 6. This shows great gains, i.e., improved shunt impedance for all bands.

Figure 7A:
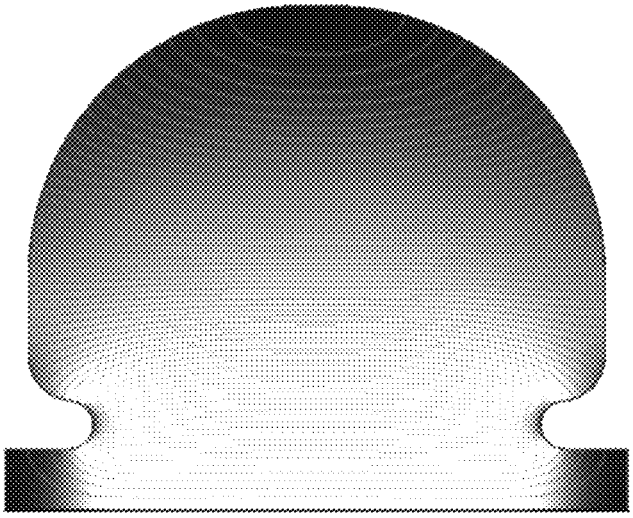
FIGS. 7A-B are cross-sectional diagrams of accelerator structures, where shading indicates E-field intensity, for multi-Frequency acceleration, according to an embodiment of the invention.
Figure 7B:
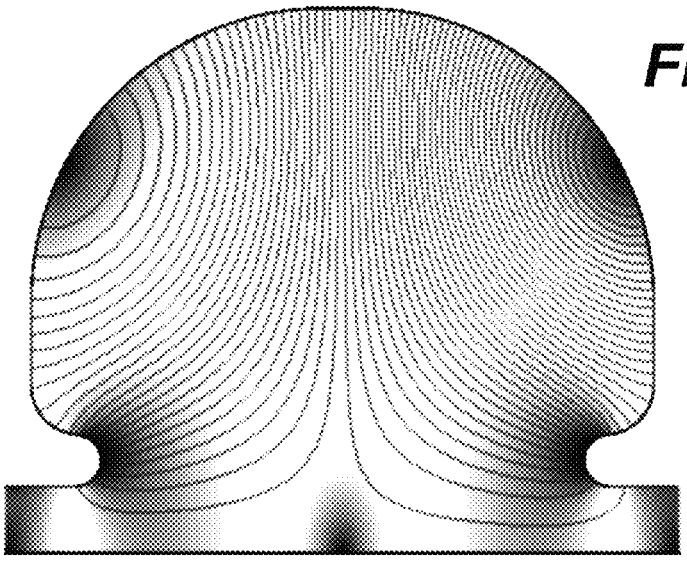

Finally, this type of topology allows the structure to be fed at more than one frequency. In FIG. 7 the structure is optimized to operate at the first two modes at two different frequencies, realizing multi-frequency acceleration. FIG. 7A is a cross-sectional view for operation at a first frequency of 11.424 GHz, where Rs is 181 MΩ/m. FIG. 7B is a cross-sectional view for operation at a second frequency of 18.309 GHz, where Rs is 63 MΩ/m. The common sub-harmonic is 300 MHz and total shunt impedance is 244 MΩ/m. The shading in the figures represents the E field intensity.

Figure 8A:
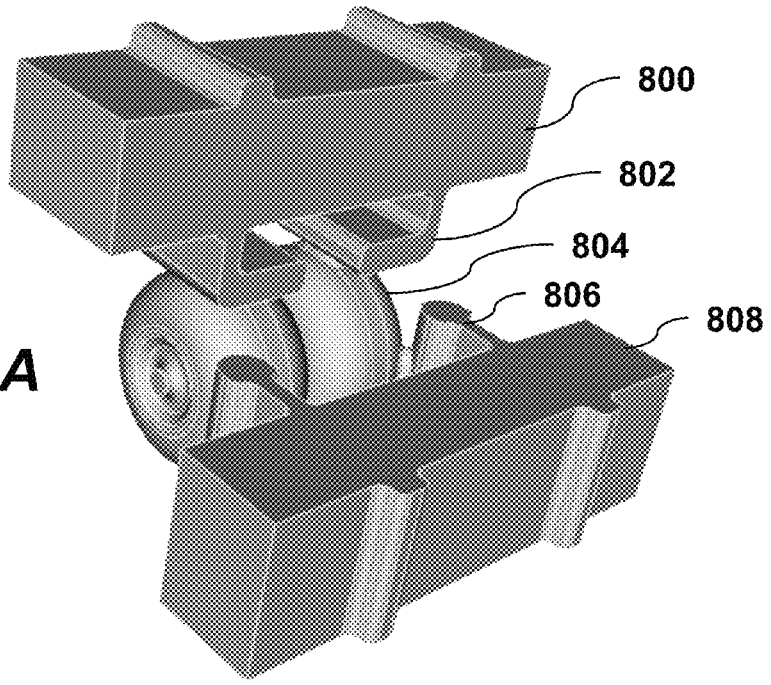
FIGS. 8A-B show perspective and cut-away views of a coupler for a two mode cavity pair, according to an embodiment of the invention.
Figure 8B:
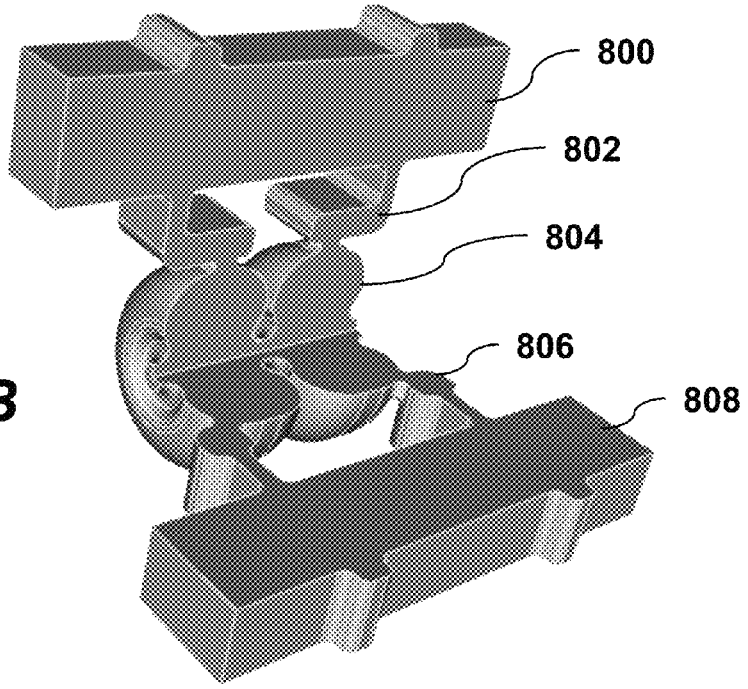
Figure 9:
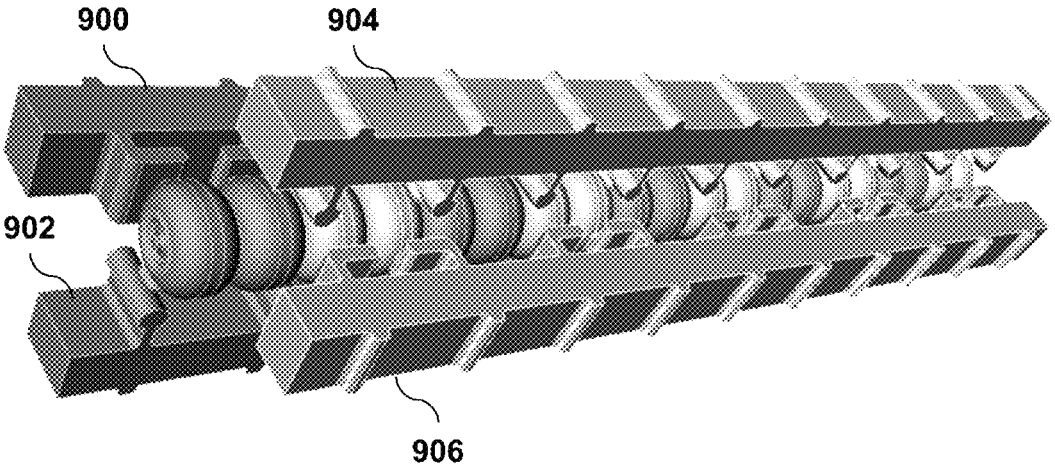
FIG. 9 is a perspective view of a two-mode, two-frequency accelerator structure, according to an embodiment of the invention.

This design provides a practical realization of multi-frequency operation. Conventional proposals for multi-frequency design insist on harmonically related frequencies. This, however, is not optimal. If one insists on harmonically related frequencies, the efficiency of the structure is degraded from that of a single frequency accelerator. However, here we break free from this idea and assume a single bunch operation. Hence we are able to use frequencies that simply have a common sub-harmonic. To implement the feeding for this structure we use two manifolds for each mode at a different frequency. The coupler for a two mode cavity pair is shown in FIGS. 8A-B, and the whole two-mode, two-frequency structure is shown in FIG. 9. Note that the coupling from the manifold 800 to the cavity 804 for the lower frequency mode is done at the center of the cavity with a bent waveguide 802. This allows coupling to this mode without disturbing the higher frequency mode. The coupling from the second manifold 808 for the higher frequency mode is achieved with a junction 806 whose design is similar to that of FIG. 3A-B by coupling on the side of the cavity 804 at the peak magnetic field point at which the coupling hole will be small enough to prevent distortion to the lower frequency mode. FIG. 9 shows the whole accelerator structure with manifolds 900, 902, 904, 906 feeding the cavity pairs.

Finally one has to iterate that the principles of the present invention are not limited to normal conducting accelerator structures but are very well applicable to superconducting accelerator structures.

The invention claimed is:

1. A microwave circuit for a linear accelerator, the microwave circuit comprising multiple metallic cell sections, a pair of distribution waveguide manifolds, and a sequence of feed arms connecting the manifolds to the cell sections;

wherein the distribution waveguide manifolds are connected to the cell sections so that alternating pairs of cell sections are connected to opposite distribution waveguide manifolds, wherein the distribution waveguide manifolds have concave modifications of their walls opposite the feed arms, and wherein the feed arms have portions of two distinct widths.

2. The microwave circuit of claim 1 wherein coupling geometry to each cell section is implemented with a three port network, wherein the three port network is adapted such that a dependence of the accelerator cavity design on a distribution manifold circuit parameter is minimized.

3. The microwave circuit of claim 2 wherein the three port network is an E-plane junction, and wherein the waveguide manifolds and three-port network are formed from two parts joined along the E-plane.

4. The microwave circuit of claim 1 wherein the distribution waveguide manifolds are connected to the cell sections by two different types of junctions adapted to allow two frequency operation.

5. The microwave circuit of claim 1 wherein each distribution waveguide manifold is composed of identical units, whereby power may be distributed evenly between accelerator structures.

6. The microwave circuit of claim 1 wherein the distribution waveguide matches a set of standing wave accelerator structures and allows for reflected power be output to external loads.

7. A method of manufacturing a microwave circuit for a linear accelerator, the method comprising making two quasi-identical parts, and joining the two parts to form the microwave circuit, wherein the microwave circuit comprises multiple metallic cell sections, a pair of distribution waveguide manifolds, and a sequence of feed arms connecting the manifolds to the cell sections; wherein the distribution waveguide manifolds are connected to the cell sections so that alternating pairs of cell sections are connected to opposite distribution waveguide manifolds, thereby allowing for many manufacturing techniques including electron beam welding, and thereby allowing the use of un-annealled copper alloys, and hence greater tolerance to high gradient operation.

8. The method of claim 7 wherein the distribution waveguide manifolds have concave modifications of their walls opposite the feed arms, and wherein the feed arms have portions of two distinct widths.

* * * * *